US008771100B2

(12) United States Patent
Matsunaga

(10) Patent No.: US 8,771,100 B2
(45) Date of Patent: Jul. 8, 2014

(54) IRON TYPE GOLF CLUB SET

(75) Inventor: Kiyofumi Matsunaga, Kobe (JP)

(73) Assignee: SRI Sports Limited, Kobe (JP)

( * ) Notice: Subject to any disclaimer, the term of this patent is extended or adjusted under 35 U.S.C. 154(b) by 245 days.

(21) Appl. No.: 13/462,520

(22) Filed: May 2, 2012

(65) Prior Publication Data

US 2012/0295729 A1 Nov. 22, 2012

(30) Foreign Application Priority Data

May 18, 2011 (JP) ..... 2011-111773

(51) Int. Cl.
*A63B 53/04* (2006.01)

(52) U.S. Cl.
USPC ..... 473/291; 473/349; 473/350

(58) Field of Classification Search
USPC ..... 473/289–291, 287, 349, 350
See application file for complete search history.

(56) References Cited

U.S. PATENT DOCUMENTS

| | | | | |
|---|---|---|---|---|
| 5,377,985 | A * | 1/1995 | Ohnishi | 473/324 |
| 5,628,698 | A * | 5/1997 | Sumitomo | 473/341 |
| 6,602,147 | B2 * | 8/2003 | Shiraishi | 473/291 |
| 6,623,374 | B1 * | 9/2003 | Helmstetter et al. | 473/291 |
| 6,835,143 | B2 * | 12/2004 | Shiraishi | 473/291 |
| 7,014,571 | B2 * | 3/2006 | Deshmukh | 473/342 |
| 7,022,028 | B2 * | 4/2006 | Nagai et al. | 473/291 |
| 7,083,531 | B2 * | 8/2006 | Aguinaldo et al. | 473/350 |
| 7,192,362 | B2 * | 3/2007 | Gilbert et al. | 473/291 |
| 7,338,387 | B2 * | 3/2008 | Nycum et al. | 473/332 |
| 2005/0085312 | A1 * | 4/2005 | Nagai et al. | 473/291 |
| 2007/0149304 | A1 * | 6/2007 | Gilbert et al. | 473/287 |
| 2009/0275421 | A1 * | 11/2009 | Gilbert et al. | 473/291 |
| 2010/0331098 | A1 * | 12/2010 | Gilbert et al. | 473/291 |

FOREIGN PATENT DOCUMENTS

| | | | |
|---|---|---|---|
| JP | 2840556 | B2 | 12/1998 |
| JP | 2001-37925 | A | 2/2001 |

* cited by examiner

*Primary Examiner* — Stephen L. Blau
(74) *Attorney, Agent, or Firm* — Birch, Stewart, Kolasch & Birch, LLP

(57) ABSTRACT

An iron type golf club set includes a set of "n" iron type golf clubs, "n" being an integer of 3 or more, wherein the golf clubs each have a different face loft angle. If the head of each golf club is inclined at a specified lie angle with respect to a horizontal plane and the face is disposed at a specified loft angle with respect to a vertical plane, the head moment of inertia "A" per unit mass represented by a ratio MI/ml of the moment of inertia "MI" of the head alone around a horizontal axis passing through the head center of gravity and being parallel to the face with respect to the head mass "m" increases in the order from the golf club with the smallest loft angle to the golf club with the largest loft angle.

11 Claims, 7 Drawing Sheets

IRON TYPE GOLF CLUB SET

BACKGROUND OF THE INVENTION

1. Field of the Invention

The present invention relates to an iron type golf club set capable of increasing a flight distance by making it easy to lift a hit ball with low numbered irons with a small loft angle, and of improving controlled performance by stabilizing a flight distance of a hit ball with high numbered irons with a large loft angle.

2. Description of the Background Art

An iron type golf club set has been known, including a set of multiple iron type golf clubs, each with a different loft angle of a face for hitting a ball. Conventionally, there are types of sets, including a set in which a head center of gravity is shifted up or down depending on a loft angle of a club head, or a set in which thickness of a top blade of a club head is varied.

Meanwhile, in high numbered irons with a large loft angle such as a wedge and the like, as a gentle face is provided, a hitting point for hitting a ball tends to vary in the up-down direction (crown-sole direction). FIGS. 10*a* to 10*c* show measurement results of variations in hitting points of target average golfers, for #5 irons (#5) with a loft angle of 24 degrees, #8 irons (#8) with a loft angle of 34 degrees, and pitching wedges (PW) with a loft angle of 44 degrees. In FIG. 10, the origin is a face center, and the horizontal axis shows a position in a toe-heel direction from the face center and the vertical axis shows a position in the up-down direction from the face center. In addition, each graph also shows an approximate straight line calculated from all the hitting points.

As is obviously seen from an inclination of the approximate straight lines, the larger loft angle a golf club has, the larger variation in the hitting points in the up-down direction it has. Thus, there is a problem that in a flow focusing on the up-down or toe-heel direction of the head center of gravity, the high numbered irons tend to have more variations in a flight distance.

SUMMARY OF THE INVENTION

The preset invention has been devised in light of the problems described above, and a primary object of the present invention is to provide an iron type golf club set capable of improving controlled performance by stabilizing a flight distance of a hit ball with the high numbered irons with a large loft angle, while being capable of increasing a flight distance by lifting a hit ball high with the low numbered irons with a small loft angle, basically by focusing on a moment of inertia "A" of a head per unit mass represented in a ratio MI/m of a moment of inertia "MI" of a head alone around a horizontal axis parallel to a face to head mass "m", changing the value according to a golf club number, and the like.

According to the present invention, an iron type golf club set, comprises a set of "n" iron type golf clubs, "n" being an integer of 3 or more, the golf clubs each having a different loft angle of a face for hitting a ball, wherein when a head of each iron type golf club is inclined at a specified lie angle with respect to a horizontal plane and the face is at a specified loft angle to a vertical plane, head moment of inertia "A" per unit mass represented by a ratio MI/m of a moment of inertia "MI" of a head alone around a horizontal axis passing through a head center of gravity and being parallel to the face to head mass "m" increases in the order from an iron type golf club with the smallest loft angle to an iron type golf club with the largest loft angle, and a difference An−A1 between head moment of inertia "An" per unit mass of the iron type golf club with the largest loft angle and head moment of inertia "A1" per unit mass of the iron type golf club with the smallest loft angle is 0.30 ($g \cdot cm^2/g$) or more.

DESCRIPTION OF THE PREFERRED EMBODIMENTS

One embodiment of the present invention will be described hereinafter based on the drawings.

Figure 1A:
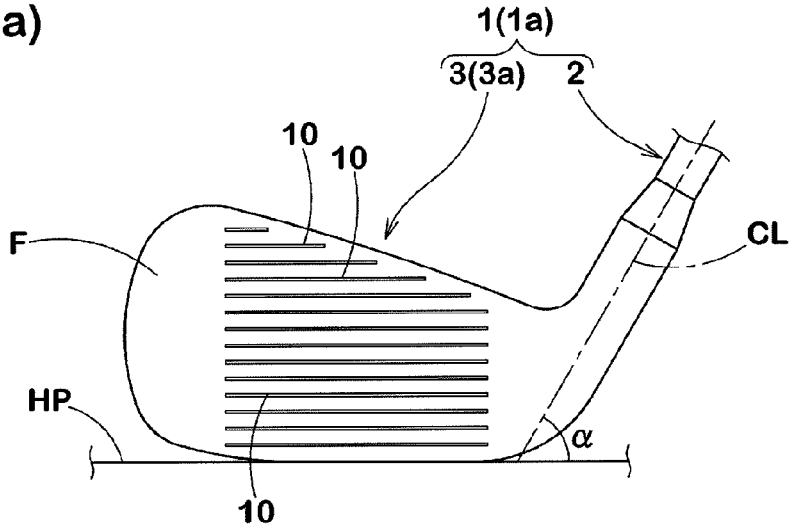
FIGS. 1*a* to 1*c* are front views of an iron type golf club set showing an embodiment of the present invention.
Figure 1B:
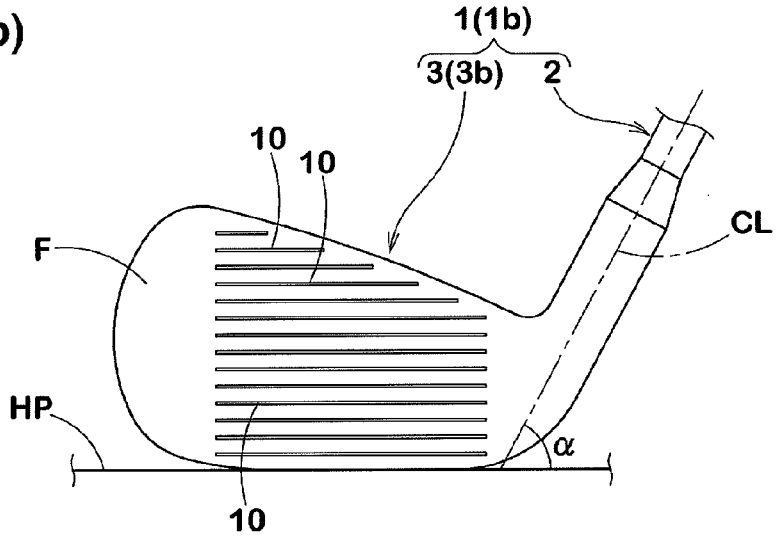
Figure 1C:
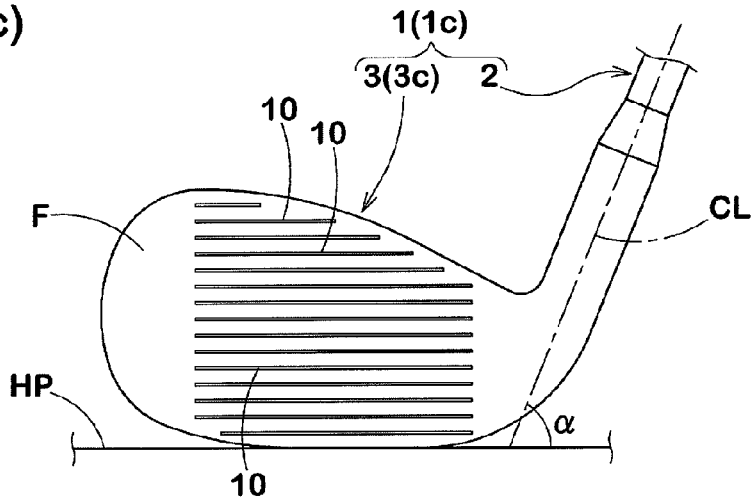
Figure 2A:
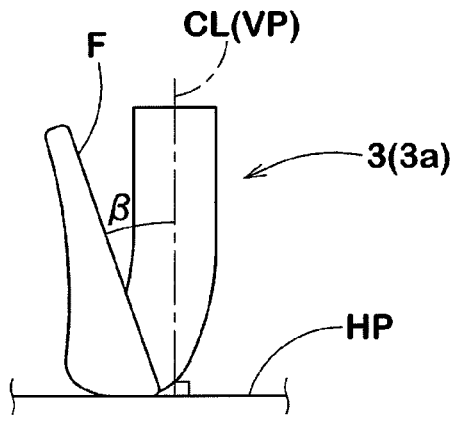
FIGS. 2*a* to 2*c* are lateral views of the iron type golf club set of FIGS. 1*a* to 1*c*.
Figure 2B:
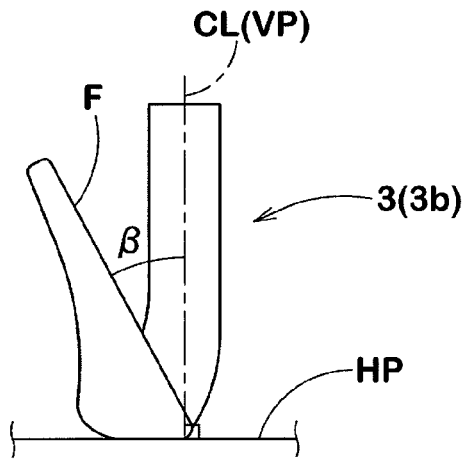
Figure 2C:
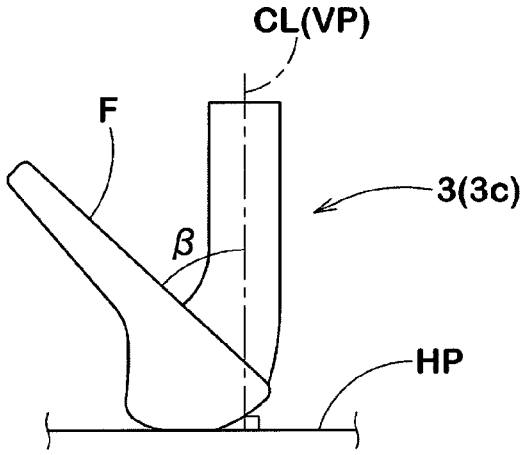

FIGS. 1*a* to 1*c* are front views of three golf clubs 1*a* to 1*c* in a standard state, which are contained in an iron type golf club set 1 (also referred to simply as a "set", hereinafter) of the embodiment. In addition, FIGS. 2*a* to 2*c* are lateral views of ahead 3 viewed from a toe side, with a shaft 2 thereof not shown.

In the specification, a standard state of a club is a state in which a centerline CL of the shaft 2 is disposed on any vertical plane VP and inclined at a lie angle α defined for the aforementioned head, a face F of the head 3 is inclined to the vertical plane VP at a loft angle β defined for the aforementioned head, and the head is grounded on a horizontal plane HP.

The set 1 of the embodiment includes "n" iron type golf clubs 1*a*, 1*b* . . . ("n" is an integer of 3 or more) each with a different loft angle β. For the set 1, the smallest loft angle β of the set is preferably set to from 19 to 27 degrees, for example, and more preferably from 21 to 26 degrees, in order to achieve wide-ranging, distinctive flight distances. Similarly, it is desirable that the largest loft angle in the set 1 is set to from 44 to 60 degrees, for example, and more preferably to from 46 to 57 degrees. Among all, in order to achieve distinctive flight distances accurately, a difference in the loft angles β of continuously numbered golf clubs in the set 1 is preferably about from 3 to 10 degrees.

In addition, although a total number of golf clubs contained in the set 1 is at least 3 clubs, the set 1 may include about from 5 to 10 clubs or from 6 to 8 clubs, by convention.

In addition, according to the convention, preferably, the shafts 2 to be attached to respective club heads 3 contained in the set 1 are formed to become gradually shorter as the loft angle β increases. In addition, preferably, a lie angle α of the respective club heads 3 contained in the set 1 is set to become gradually larger as the loft angle β increases.

FIG. 1*a* shows a #3 iron as a long iron, which has the smallest loft angle (β=21 degrees in the example) as an iron type golf club. FIG. 1*c* shows a pitching wedge as a short iron which has the largest loft angle (β=51 degrees in the example). In addition, FIG. 1*b* shows a #6 iron as a middle iron which has aloft angle therebetween (β=27 degrees in the example). In addition, a lower club number is assigned to a club with a smaller loft angle, while a higher club number is assigned to a club with a larger loft angle.

Figure 3:
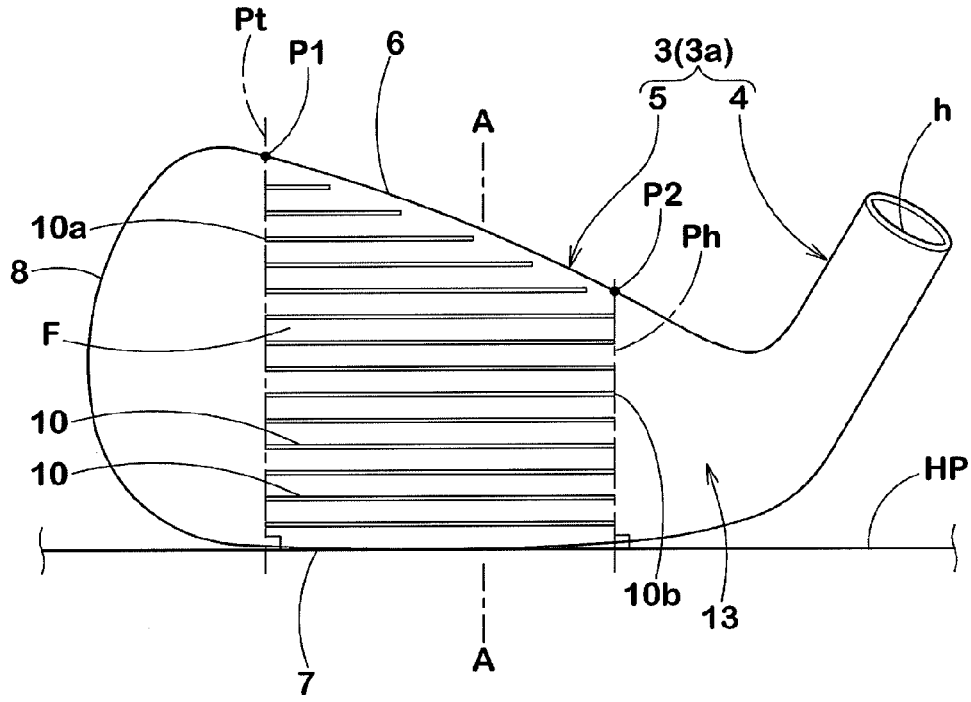
FIG. 3 is a front view of a golf club head in a perpendicular state, which has been taken out of the set of the present invention.
Figure 4:
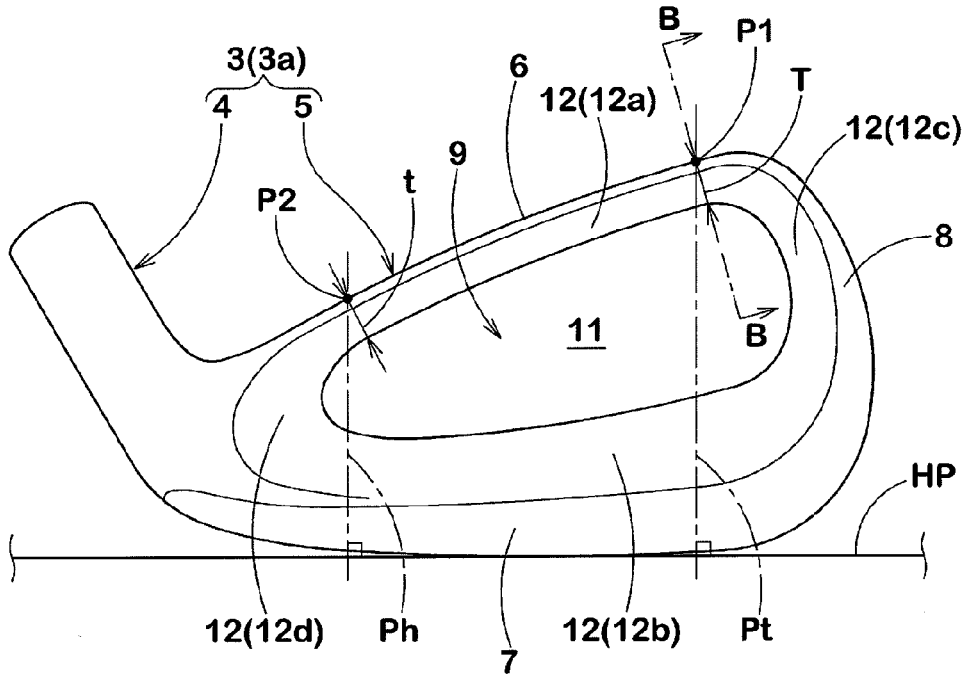
FIG. 4 is a rear view of the golf club head of FIG. 3 in the perpendicular state.
Figure 5:
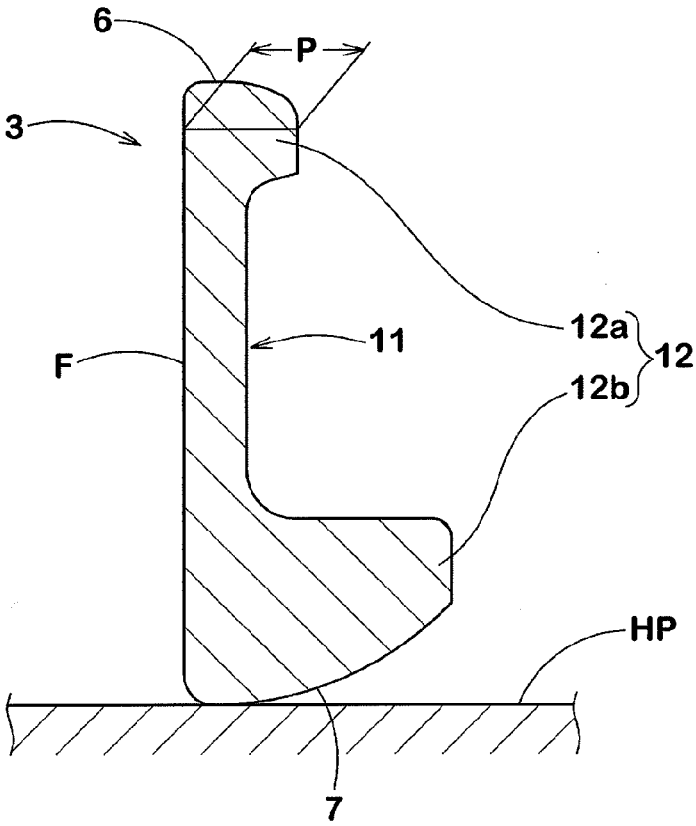
FIG. 5 is a cross sectional view taken along the line A-A in FIG. 3.

FIG. 3 is a front view of a club head 3*a* of FIG. 1*a* in a perpendicular state as a typical example, FIG. 4 is a rear view thereof, and FIG. 5 is a cross sectional view taken along the line A-A in FIG. 3. Here, the perpendicular state shall be a state in which the face F in the standard state is inclined forward so that the loft angle β is 0 degree.

Each club head 3 as a whole of the embodiment consists of a metal material, and has a hosel portion 4 to which the shaft 2 is attached, and a head main body 5 which is provided in the hosel portion 4 in a coupled manner and whose front face constitutes the face F for hitting a ball.

The metal material composing the head 3 is optimally soft iron, stainless steel, maraging steel, and/or titanium alloy and the like, for example, and one type or two or more types of which are used. In addition, the club head 1 may be formed by using casting, forging, or rolled material, and the like.

The hosel portion 4 is formed as an almost circular cylinder with a shaft insertion hole h into which the shaft 2 is attached. In addition, the head main body 5 is formed integrally with the hosel portion 4 via a neck portion 13.

The head main body 5 is sectioned into the face F for hitting a ball, a top face 6 extending backwardly from the upper edge of the face F so as to form a head top surface, a sole face 7 extending backwardly from the lower edge of the face F so as to form a bottom surface of the head, a toe face 8 connecting the sole face 7 and the top face 6 on the toe side, and a back face 9 constituting a backside of the face F.

Face grooves 10 are provided on the face F to increase friction with a ball. The face F is substantially formed as a single plane except for the face grooves 10. The face grooves 10, extending in the toe-heel direction, include multiple grooves formed with intervals above and under them. The face grooves 10 extending in the toe-heel direction may be any grooves as long as they are considered to run almost along the toe-heel direction when the face grooves 10 are observed with the naked eye. Specifically, in a front view of the perpendicular state, the face grooves 10 are desirably inclined to the horizontal plane HP in the range of ±2 degrees, or more preferably, within the range of ±1 degree.

In addition, on the back face 9 of the head main body 5 are provided with a cavity 11 which is hollowed out toward the face F, and a blade portion 12 which swells toward the backside of the head and extends around the cavity 11. In this manner, the head 3 of the embodiment is formed as a so-called cavity-back type.

In the embodiment, the blade portion 12 continues annularly, including a top blade portion 12*a* which extends along the top face 6 in the toe-heel direction, a sole blade portion 12*b* which extends along the sole face 7 in the toe-heel direction, a toe blade portion 12*c* and a heel blade portion 12*d* which connect therebetween, respectively on the toe side and the heel side. Such a blade portion 12 can allocate more weight to the backside of the head 3 and the periphery of the face F. Then, a position of the head center of gravity G or a moment of inertia can be adjusted by adjusting width T (as shown in FIG. 4) of such a blade portion 12 and/or an amount of thickness P (as shown in FIG. 5) to the head backside.

In the present invention, the following two characteristics are adopted for the set 1, focusing on a parameter of a moment of inertia A of the head per unit mass.

(a) The head moment of inertia A1 . . . An per unit mass shall increase in the order from the golf club 1*a* with the smallest loft angle to the golf club 1*c* with the largest loft angle.

(b) A difference An−A1 between the head moment of inertia "An" per unit mass of the golf club 1*c* with the largest loft angle and the head moment of inertia "A1" per unit mass of the golf club 1*a* with the smallest loft angle shall be 0.30 ($g \cdot cm^2/g$) or more.

Figure 6:
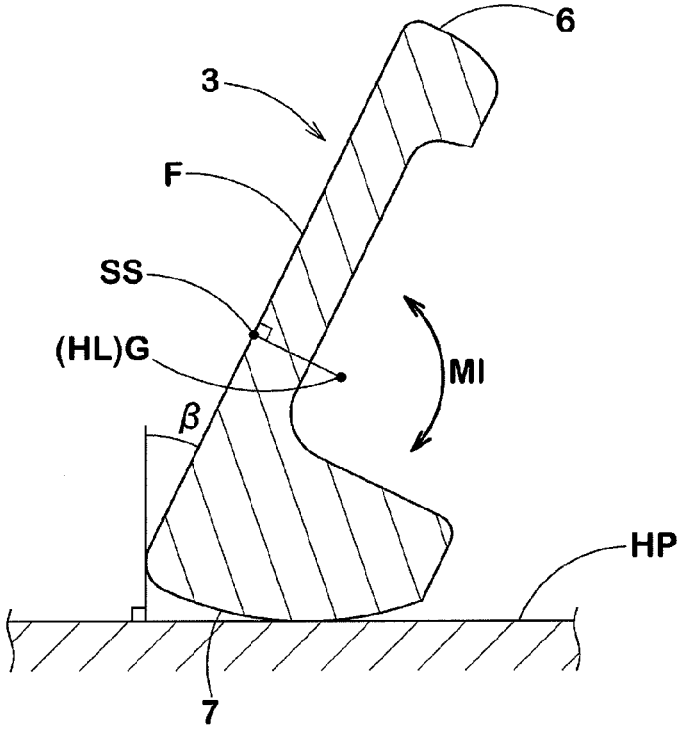
FIG. 6 is the cross sectional view taken along the line A-A in a standard state.

First, the head moment of inertia "A" per unit mass is defined as a ratio MI/m of a moment of inertia "MI" ($g \cdot cm^2$) of the head alone around the horizontal axis HL passing through the head center of gravity G and being parallel to the face F to head mass "m" (g), in the standard state in which, as shown in FIG. 6, the head 3 is placed on a horizontal plane at the specified lie angle α and the loft angle β.

The moment of inertia "MI" is also referred to as a "vertical moment of inertia" and is a parameter which has an effect on a shift (minute amount of rotation) of the head when hitting points of balls vary on the upper and lower sides of the face F. That is to say, a head with the large moment of inertia "MI" can not only control any shift of the head around the horizontal axis HL but also prevent a possible reduction in restitution performance, even when hitting points vary on the upper and lower sides of the face F with respect to a sweet spot SS. This can stabilize flight distances of hit balls even if hitting points vary up and down.

On the other hand, each head 3 contained in the iron type golf club set 1 differs not only in the loft angle but also in size such as length in the toe-heel direction, length of the hosel portion 4 and the like, and thus also differs in head mass "m". In particular, there is a tendency that the larger loft angle a head has, the larger head mass it has. Hence, just focusing on a value of the moment of inertia "MI" in the set and adjusting these specifications, the effect of stabilizing flight distances commensurate with the head mass may not be fully obtained.

Thus, as described in the characteristic (a), the present invention is set so that the head moment of inertia A1 . . . An per unit mass increases in the order from the golf club 1*a* with the smallest loft angle to the golf club 1*c* with the largest loft angle. That is to say, the set 1 with n=5 satisfies the following expression (1).

$$A1<A2<A3<A4<A5 \quad (1)$$

Therefore, even with a high numbered club whose hitting points tend to vary up and down, a shift of the head can be controlled and variations in flight distances are smaller, because the head moment of inertia per unit mass is large. This further stabilizes flight distances of hit balls as the loft angle of high numbered clubs increases, irrespective of the head mass. Therefore, in wedges and the like which are often used to directly get the ball onto the green, this can stabilize flight distances more effectively and improve accuracy of shots.

In addition, in the set 1, lower numbered golf clubs having a smaller loft angle are requested to achieve larger flight distances. In this respect, in the present invention, the characteristic (b) is adopted. Specifically, a difference An−A1 between the head moment of inertia "An" per unit mass of the golf club 1*c* with the largest loft angle and the head moment of inertia "A1" per unit mass of the golf club 1*a* with the smallest loft angle is set to 0.30 ($g \cdot cm^2/g$) or more. In other words, the head moment of inertia A1 per unit mass of the golf club 1*a* with the smallest loft angle is set smaller than the head moment of inertia "An" per unit mass of the golf club 1*c* with the largest loft angle, in a certain range.

If the head moment of inertia "A" per unit mass is set smaller, it is desirable to set only the moment of inertia "MI" smaller without increasing the mass m of the entire head. To this end, it is effective to set the head center of gravity G lower. For the low numbered clubs with the small loft angle, it becomes more likely that balls are hit by the part above the sweet spot of the hitting face, and thus an amount of back spin increases due to gear effect, which helps golfers in lifting balls and increasing flight distances.

In addition, although the difference An−A1 in the head moment of inertia per unit mass is 0.30 ($g \cdot cm^2/g$) or more, it is desirable from results of various experiments that it is preferably 0.32 ($g \cdot cm^2/g$) or more, more preferably 0.35 ($g \cdot cm^2/g$) or more, even more preferably 0.40 ($g \cdot cm^2/g$) or more, and, in particular, preferably 0.45 ($g \cdot cm^2/g$) or more. This can balance in a higher level the effects of increasing flight distances of low numbered clubs (long iron) and of stabilizing flight distances of high numbered clubs. In addition, it is desirable that an upper limit of the difference An−A1 is preferably 1.00 ($g \cdot cm^2/g$) or less, more preferably 0.90 ($g \cdot cm^2/g$) or less, even more preferably 0.80 ($g \cdot cm^2/g$) or less, and, in particular, preferably, 0.52 ($g \cdot cm^2/g$) or less. If the difference exceeds 1.00 ($g \cdot cm^2/g$), variations may become more noticeable in flight distances of the low numbered clubs or the amount of back spin may increase in hit balls of the high numbered clubs, which thus reduces flight distances.

In addition, for the low numbered head 3*a* with the smallest loft angle β in the set 1, it is desirable that a value of the head moment of inertia "A" per unit mass is from 2.85 to 3.35 ($g \cdot cm^2/g$). When a value of the head moment of inertia "A" per unit mass is less than 2.85 ($g \cdot cm^2/g$), there is a tendency that the moment of inertia MI becomes small and variations in flight distances become larger relative to variations in hit points in the up-down direction, and above all, the value is preferably 2.94 ($g \cdot cm^2/g$) or more.

On the other hand, for the low numbered head 3*a* with the smallest loft angle β in the set 1, when a value of the head moment of inertia "A" per unit mass exceeds 3.35 ($g \cdot cm^2/g$), there is a tendency that height H of the sweet spot increases, thus making it more difficult to lift hit balls. From such a standpoint, for the low numbered head 3*a* with the smallest loft angle β, it is desirable that a value of the head moment of inertia "A" per unit mass is preferably 3.30 ($g \cdot cm^2/g$) or less, more preferably 3.25 ($g \cdot cm^2/g$) or less, and, in particular, preferably 3.07 ($g \cdot cm^2/g$) or less. In addition, for the high numbered head 3*c* with the largest loft angle β in the set 1, it is desirable that a value of the moment of inertia "A" is from 3.37 to 4.01 ($g \cdot cm^2/g$).

A value of head moment of inertia "A" per unit mass of each head 3 can be freely set by adjusting the moment of inertia "MI" and/or the head mass "m". In addition, according to the convention, the moment of inertia "MI" and the head mass "m" can be changed by mass allocation design through adjustment of thickness of each portion of the head 3 or by designing constituent materials, etc.

For the head 3 of the cavity back type as in the embodiment, for example, the moment of inertia "MI" can be easily adjusted by making the width of the blade portions 12 differ for each golf club number. In general, for a head 3 of an iron type golf club, more mass is allocated to the sole side and the heel side, because of a shape thereof. Thus, in order to increase the moment of inertia "MI" around the horizontal axis HL, it is effective to allocate more mass to the upper side and the toe side of the head 3.

As the one example, in order to make adjustment so that for clubs with a higher number and a larger loft angle in the set 1, the moment of inertia "MI" around the horizontal axis HL becomes larger, as shown in FIG. 4, in a back view of the face F, it is desirable to adjust specifications so that the width T of the top blade portion 12*a* on the toe side increases in the order from the low numbered club 1*a* with the smallest loft angle to the high numbered club 1*c* with the largest loft angle. Specifically, when the width T is sequentially represented by Ti (i=integer from 1 to 5 in this example) from the low numbered club 1*a* to the high numbered club 1*c*, it is desirable that the Ti is set so as to satisfy the following expression (2).

$$T1<T2<T3<T4<T5 \quad (2)$$

Above all, the moment of inertia "MI" can be progressively increased more effectively, by ensuring that a difference T5−T1 between the width T5 of the head 3*a* with the largest loft angle and the width T1 of the head 3*c* with the smallest loft angle is 2 mm or more, and more preferably 3 mm or more. In addition, it is preferred that the width T1 is preferably about from 1 to 7 mm, and more preferably from 5 to 7 mm.

Figure 7:
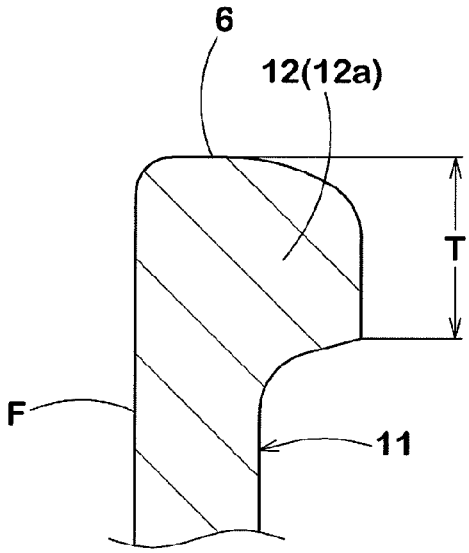
FIG. 7 is a cross sectional view taken along the line B-B in FIG. 4.

In order to standardize within the set a position to measure the width T of the top blade portion 12*a* on the toe side, the position shall be a position of an intersection P1 of a perpendicular plane Pt passing through an end 10*a* of the face groove 10 on the toe side and the contour line of the top face 6, as shown in FIG. 3 and FIG. 4, and from the position, the width shall be measured in a direction perpendicular to the contour line of the top face 6. In addition, the width T shall be measured in a direction along the face F, as shown in FIG. 7 (which is the B-B cross section of FIG. 4).

Figure 8:
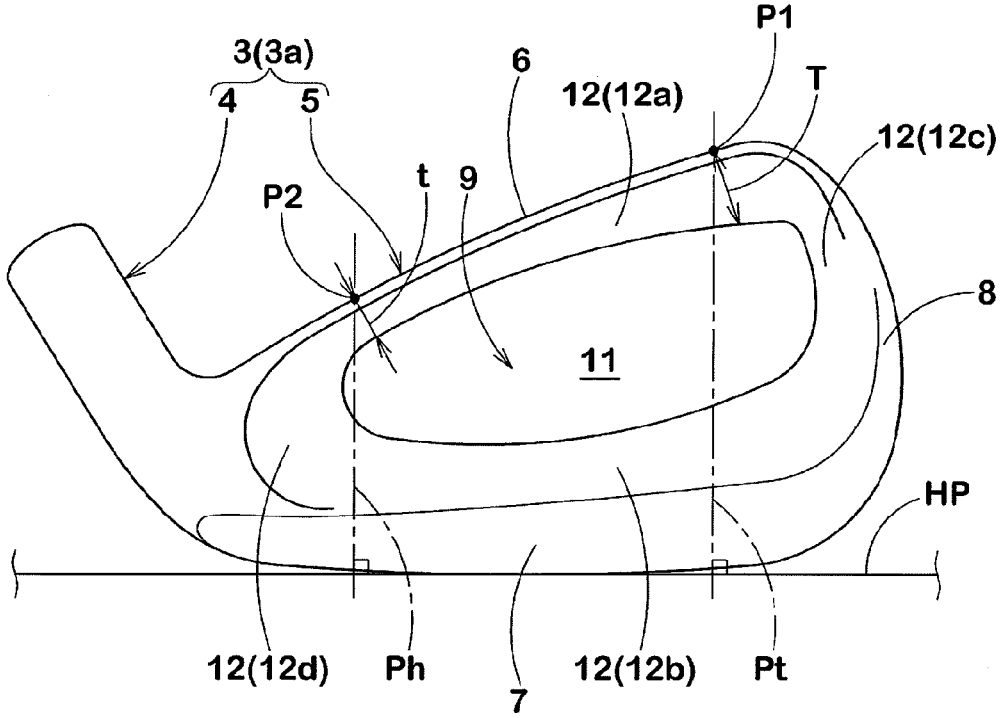
FIG. 8 is a rear view of an iron type golf club head of other embodiment.

FIG. 8 shows one example in which the width T is made larger than that of the head 3 in FIG. 4. As such a head 3 can allocate more mass to the upper side and the toe side of the head, compared with one shown in FIG. 4, the moment of inertia "MI" can be effectively increased with a smaller mass increase, by balancing with a sole blade having essentially large thickness, and the like.

In addition, as in the embodiment, if the width T of the top blade portion 12*a* on the toe side is increased, in a back view of the face, width t of the top blade portion 12*a* on the heel side is desirably same for the low numbered club 1*a* with the smallest loft angle β to the high numbered club 1*c* with the largest loft angle β. Specifically, if the width t of the top blade portion 12*a* on the heel side is increased, it may not be possible to effectively increase the moment of inertia "MI" in view of a position of the head center of gravity G.

In order to standardize within the set a position to measure the width t of the top blade portion 12*a* on the heel side, the position shall be a position of an intersection P2 of a perpendicular plane Ph passing through an end 10*b* of the face groove 10 on the heel side and the contour line of the top face 6, as shown in FIG. 3 and FIG. 4, and from that position, the width shall be measured in a direction perpendicular to the contour line of the top face 6. In addition, the width t shall be measured in a direction along the face F, similar to the one shown in FIG. 7 (which is the B-B cross section of FIG. 4). The width t shall be preferably from 2 to 7 mm. In addition, it is desirable that the width t is, in particular, preferably fixed in the area of 5 mm to the right and left from the position of the intersection P2 along the top face 6.

Therefore, as shown in FIG. 8, for the high numbered heads, it is especially preferable that the width of the top blade portion 12*a* not only achieves constant thickness on the heel side, but also progressively increases therefrom to the toe side.

Although the embodiments of the present invention have been described above, it is needless to say that the present invention is not limited to the above embodiments and that it can be embodied by changing it to various aspects.

EXAMPLES

In order to confirm the effects of the present invention, an iron type golf club set (set of 6 clubs from #5 to #9 and Pw) with a cavity-back shape as shown in Table 1 and FIG. 3 and FIG. 4 was prototyped, and various tests were carried out on them. Shown below are basic common specifications of each club head.

Head material: A complex of a main body of SUS630 and face members of 6-4Ti

| Loft angles: | |
|---|---|
| #5: | 24 degrees |
| #6: | 27 degrees |
| #7: | 30 degrees |
| #8: | 34 degrees |
| #9: | 39 degrees |
| # PW: | 44 degrees |

Width T of the top blade portion on the toe side: To be adjusted in the range of from 5.0 to 9.0 mm Width t of the top blade portion on the heel side: To be adjusted in the range of from 5.0 to 6.0 mm A test method is as follows. Easiness to lift a hit ball and variation in flight distances:

Five golfers with handicap of 5 to 15 carried out actual hitting tests, using each test club and commercially available 3-piece golf balls "XXIO" (registered trademark in Japan of SRI Sports Limited) made by SRI sports Limited. Each golfer hit 10 balls with each test club, and easiness to 11 ft a hit ball and variation in flight distances, which is a difference between a maximum flight distance and a minimum flight distance, were evaluated. For the variation, it is shown that the smaller a numeric value is, the fewer the variation is. In addition, for the easiness to lift hit balls, a ten-point method based on the following criteria was adopted.

1 point: A hit ball does not rise easily.

5 points: Moderate and good.

10 points: A hit ball rises too high.

Figure 9:
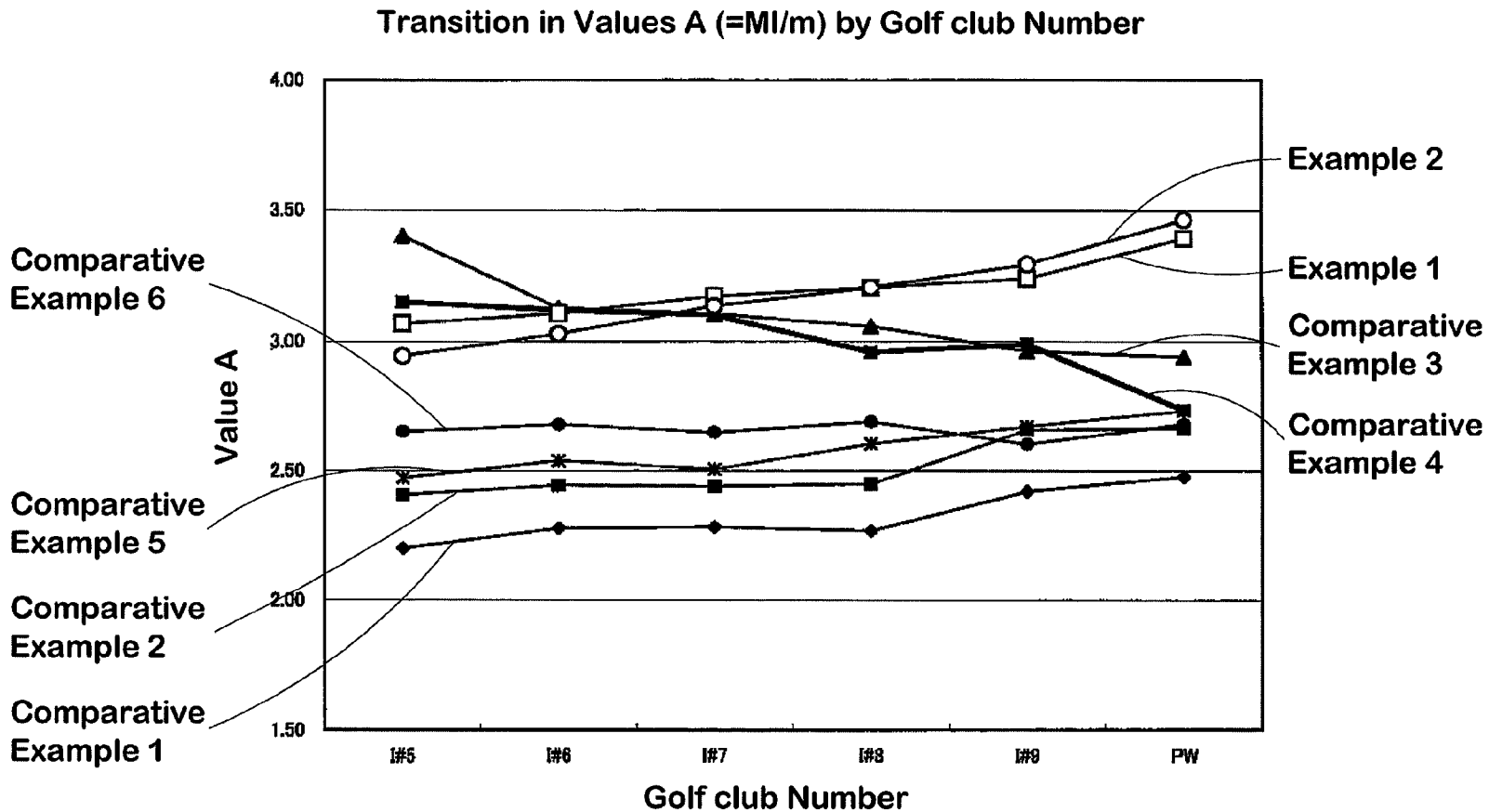
FIG. 9 is a graph showing a transition in the golf club number of a value "A" of examples and comparative examples.
Figure 10A:
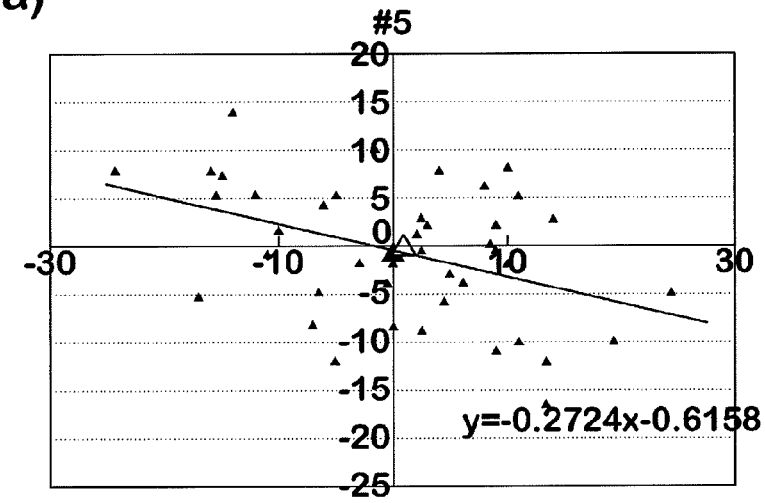
FIGS. 10*a* to 10*c* are graphs showing a distribution of hitting points of a face.
Figure 10B:
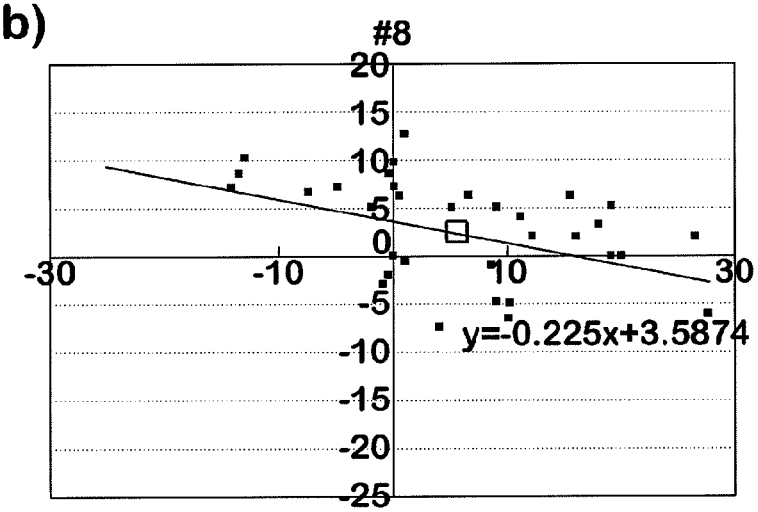
Figure 10C:
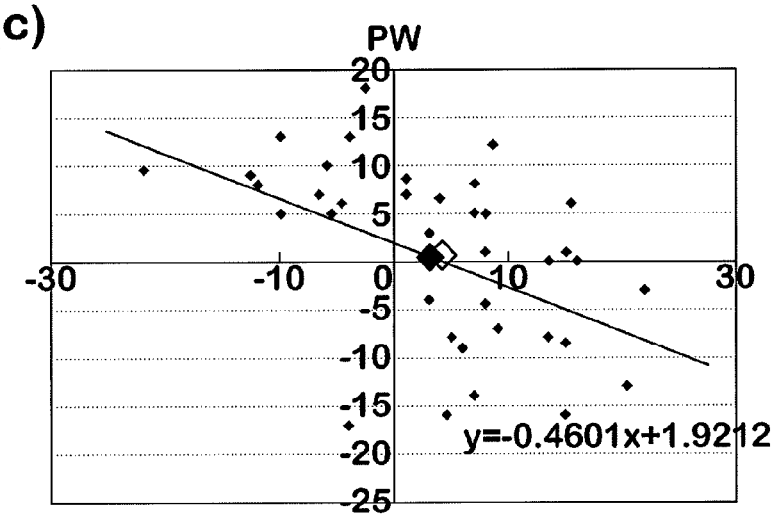

FIG. 9 shows a value A of head moment of inertia per unit mass and transition in golf club numbers for the examples 1, 2 and a comparative example. In addition, Table 1 shows test results.

TABLE 1

| | Golf Club Number | m (g) | MI (g · cm$^2$) | A (g · cm$^2$/g) | Difference An − A1 (g · cm$^2$/g) | Easiness to lift a hit ball (10-point method) | Variation in flight distances (yards) |
|---|---|---|---|---|---|---|---|
| Comparative example 1 | I#5 | 250 | 550 | 2.20 | — | 10 | 17 |
| | I#6 | 256 | 583 | 2.28 | — | 9 | 15 |
| | I#7 | 263 | 600 | 2.28 | — | 9 | 15 |
| | I#8 | 270 | 612 | 2.27 | — | 9 | 15 |
| | I#9 | 277 | 670 | 2.42 | — | 8 | 13 |
| | PW | 286 | 708 | 2.48 | 0.28 | 8 | 10 |
| Comparative example 2 | I#5 | 251 | 604 | 2.41 | — | 8 | 13 |
| | I#6 | 258 | 630 | 2.44 | — | 8 | 11 |
| | I#7 | 265 | 646 | 2.44 | — | 8 | 11 |
| | I#8 | 273 | 668 | 2.45 | — | 8 | 11 |
| | I#9 | 281 | 747 | 2.66 | — | 8 | 9 |
| | PW | 289 | 770 | 2.66 | 0.26 | 8 | 8 |
| Comparative example 3 | I#5 | 251 | 854 | 3.40 | — | 3 | 7 |
| | I#6 | 259 | 810 | 3.13 | — | 4 | 7 |
| | I#7 | 268 | 832 | 3.10 | — | 4 | 7 |
| | I#8 | 276 | 844 | 3.06 | — | 5 | 7 |
| | I#9 | 283 | 838 | 2.96 | — | 6 | 7 |
| | PW | 288 | 847 | 2.94 | −0.46 | 7 | 6 |
| Comparative example 4 | I#5 | 245 | 772 | 3.15 | — | 4 | 12 |
| | I#6 | 251 | 783 | 3.12 | — | 4 | 11 |
| | I#7 | 260 | 806 | 3.10 | — | 5 | 11 |
| | I#8 | 265 | 784 | 2.96 | — | 6 | 11 |
| | I#9 | 273 | 816 | 2.99 | — | 7 | 12 |
| | PW | 283 | 774 | 2.73 | −0.42 | 8 | 8 |
| Comparative example 5 | I#5 | 254 | 628 | 2.47 | — | 8 | 13 |
| | I#6 | 262 | 665 | 2.54 | — | 7 | 12 |
| | I#7 | 269 | 674 | 2.51 | — | 7 | 12 |
| | I#8 | 275 | 716 | 2.60 | — | 8 | 11 |
| | I#9 | 283 | 756 | 2.67 | — | 8 | 10 |
| | PW | 291 | 795 | 2.73 | 0.26 | 8 | 7 |
| Comparative example 6 | I#5 | 256 | 679 | 2.65 | — | 7 | 12 |
| | I#6 | 261 | 699 | 2.68 | — | 7 | 13 |
| | I#7 | 270 | 715 | 2.65 | — | 7 | 12 |
| | I#8 | 277 | 745 | 2.69 | — | 7 | 13 |
| | I#9 | 282 | 734 | 2.60 | — | 7 | 11 |
| | PW | 291 | 780 | 2.68 | 0.03 | 7 | 10 |
| Example 1 | I#5 | 248 | 761 | 3.07 | — | 5 | 9 |
| | I#6 | 254 | 789 | 3.11 | — | 5 | 8 |
| | I#7 | 261 | 828 | 3.17 | — | 5 | 7 |
| | I#8 | 269 | 862 | 3.20 | — | 5 | 6 |
| | I#9 | 276 | 894 | 3.24 | — | 5 | 5 |
| | PW | 281 | 953 | 3.39 | 0.32 | 5 | 4 |

TABLE 1-continued

| | Golf Club Number | m (g) | MI (g · cm²) | A (g · cm²/g) | Difference An – A1 (g · cm²/g) | Easiness to lift a hit ball (10-point method) | Variation in flight distances (yards) |
|---|---|---|---|---|---|---|---|
| Example 2 | I#5 | 248 | 730 | 2.94 | — | 6 | 10 |
| | I#6 | 254 | 769 | 3.03 | — | 5 | 9 |
| | I#7 | 261 | 818 | 3.13 | — | 5 | 8 |
| | I#8 | 269 | 862 | 3.20 | — | 5 | 7 |
| | I#9 | 276 | 909 | 3.29 | — | 4 | 5 |
| | PW | 281 | 973 | 3.46 | 0.52 | 4 | 3 |
| Example 3 | I#5 | 248 | 730 | 2.94 | — | 6 | 10 |
| | I#6 | 254 | 801 | 3.15 | — | 5 | 8 |
| | I#7 | 261 | 875 | 3.35 | — | 5 | 6 |
| | I#8 | 269 | 951 | 3.54 | — | 4 | 4 |
| | I#9 | 276 | 994 | 3.60 | — | 4 | 3 |
| | PW | 281 | 1023 | 3.64 | 0.70 | 4 | 2 |
| Example 4 | I#5 | 248 | 730 | 2.94 | — | 6 | 10 |
| | I#6 | 254 | 805 | 3.17 | — | 5 | 8 |
| | I#7 | 261 | 880 | 3.37 | — | 5 | 6 |
| | I#8 | 269 | 955 | 3.55 | — | 4 | 4 |
| | I#9 | 276 | 1030 | 3.73 | — | 3 | 3 |
| | PW | 281 | 1105 | 3.93 | 0.99 | 3 | 2 |
| Example 5 | I#5 | 248 | 730 | 2.94 | — | 6 | 10 |
| | I#6 | 254 | 811 | 3.19 | — | 4 | 8 |
| | I#7 | 261 | 891 | 3.41 | — | 4 | 6 |
| | I#8 | 269 | 973 | 3.62 | — | 3 | 4 |
| | I#9 | 276 | 1053 | 3.82 | — | 3 | 3 |
| | PW | 281 | 1128 | 4.01 | 1.07 | 3 | 2 |

In a set of a comparative example 1, moment of inertia "A" per unit mass does not increase gradually among #6, #7, and #8 iron clubs, and as a difference of the moment of inertia "A" is less than 0.30 (g·cm²/g), variations in fight distances of low numbered clubs, in particular, has not been improved.

Also in sets of the comparative examples 2, 5 and 6, moment of inertia "A" per unit mass does not increase gradually, either, and the difference in the moment of inertia "A" is less than 0.30 (g·cm²/g). Because the value "A" is large, the variation in flight distances has been improved to some extent compared with the comparative example 1. However, the improvement is still not enough. In addition, it is not easy to lift hit balls with low numbered clubs.

In the set of the comparative examples 3 and 4, the moment of inertia "A" per unit mass becomes smaller for higher numbered clubs. In addition, the difference in the moment of inertia "A" is less than 0.30 (g·cm²/g). Thus, hit balls were not easily lifted with the low numbered clubs, and it was not possible to obtain sufficient flight distances.

In contrast to this, in the sets of the examples 1 and 2, the moment of inertia "A" per unit mass is larger for higher numbered clubs, and the difference thereof is also 0.30 (g·cm²/g) or more. Thus, hit balls were easily lifted with low numbered clubs, while the variation in flight distances was controlled with high numbered clubs. Hence, the significant effects could be confirmed.

What is claimed is:

1. An iron type golf club set, comprising a set of "n" iron type golf clubs, "n" being an integer of 3 or more, the golf clubs each having a different loft angle of a face for hitting a ball, wherein when a head of each iron type golf club is inclined at a specified lie angle with respect to a horizontal plane and the face is at a specified loft angle to a vertical plane, head moment of inertia "A" per unit mass represented by a ratio MI/m of a moment of inertia "MI" of a head alone around a horizontal axis passing through a head center of gravity and being parallel to the face to head mass "m" increases in the order from an iron type golf club with the smallest loft angle to an iron type golf club with the largest loft angle, and a difference An–A1 between head moment of inertia "An" per unit mass of the iron type golf club with the largest loft angle and head moment of inertia "A1" per unit mass of the iron type golf club with the smallest loft angle is 0.30 (g·cm²/g) or more.

2. The iron type golf club set according to claim 1, wherein a head of each iron type golf club comprises a hosel portion to which a shaft is attached, and a head main body which is provided with the hosel portion in a coupled manner and whose front face constitutes the face, the back of the head main body has a cavity which is hollowed out toward the face, and atop blade portion which swells toward the back of the head and extends on the upper side of the cavity in a toe-heel direction, and in a rear view of the face, width of the top blade portion on the toe side increases in the order from a low numbered iron type golf club with the smallest loft angle to a high numbered iron type golf club with the largest loft angle.

3. The iron type golf club set according to claim 2 wherein in the rear view of the face, width of the top blade portion on the heel side is the same from the low numbered iron type golf club with the smallest loft angle to the high numbered iron type golf club with the largest loft angle.

4. The iron type golf club set according to claim 2 or 3 wherein in the rear view of the face, a difference T5–T1 between width T5 of the top blade portion on the toe side of the head with the largest loft angle and width T1 of the top blade portion on the toe side of the head with the smallest loft angle is 2 mm or more.

5. The iron type golf club set according to claim 4 wherein the width T1 is from 1 to 7 mm.

6. The iron type golf club set according to any of claims 1 to 3 wherein the smallest loft angle of the set is from 19 to 27 degrees.

7. The iron type golf club set according to any of claims 1 to 3 wherein the largest loft angle of the set is from 44 to 60 degrees.

8. The iron type golf club set according to any of claims 1 to 3 wherein a difference in the loft angles of contiguously numbered golf clubs in the set is 3 to 10 degrees.

9. The iron type golf club set according to any of claims 1 to 3 wherein the difference An−A1 in the head moment of inertia per unit mass is 1.00 ($g \cdot cm^2/g$) or less.

10. The iron type golf club set according to any of claims 1 to 3 wherein in the head with the smallest loft angle in the set, the head moment of inertia "A" per unit mass is from 2.85 to 3.35 ($g \cdot cm^2/g$).

11. The iron type golf club set according to any of claims 1 to 3 wherein in the head with the largest loft angle in the set, the head moment of inertia "A" per unit mass is from 3.37 to 4.01 ($g \cdot cm^2/g$).

* * * * *